United States Patent [19]

Ueda et al.

[11] Patent Number: 4,848,076

[45] Date of Patent: Jul. 18, 1989

[54] INTERCONNECTING SYSTEM FOR A WINDER AND A TWO-FOR-ONE TWISTING MACHINE

[75] Inventors: Yutaka Ueda, Nara; Shoichi Tone; Tsukasa Kawarabashi, both of Kyoto, all of Japan

[73] Assignee: Murata Kikai Kabushiki Kaisha, Kyoto, Japan

[21] Appl. No.: 148,686

[22] Filed: Jan. 26, 1988

[30] Foreign Application Priority Data

Jan. 30, 1987 [JP] Japan ..... 62-20152
Feb. 5, 1987 [JP] Japan ..... 62-25104

[51] Int. Cl.[4] ..... D01H 9/18; D01H 9/02
[52] U.S. Cl. ..... 57/281; 57/58.49
[58] Field of Search ..... 57/266, 267, 281, 58.49, 57/58.54, 58.55, 58.72, 276

[56] References Cited

U.S. PATENT DOCUMENTS

| | | | |
|---|---|---|---|
| 3,429,113 | 2/1969 | Nimtz et al. | 57/281 |
| 3,599,413 | 8/1971 | Nimtz et al. | 57/281 X |
| 4,432,198 | 2/1984 | D'Angolo | 57/266 X |
| 4,484,435 | 11/1984 | Fritjof | 57/281 X |
| 4,660,368 | 4/1987 | Küpper | 57/281 |
| 4,660,370 | 4/1987 | Matsui et al. | 57/281 |
| 4,683,713 | 8/1987 | Matsui et al. | 57/281 |
| 4,730,450 | 3/1988 | Tone | 57/281 |

*Primary Examiner*—Donald Watkins
*Attorney, Agent, or Firm*—Spensley Horn Jubas & Lubitz

[57] ABSTRACT

An automatic winder and a two-for-one twisting machine are interconnected by a yarn supply package exchanging device for a set of two packages arranged in two upper and lower stages which is located between the automatic winder and the two-for-one twisting machine. Doffed packages at the winder side are put on a yarn support fitted on a tray by the yarn supply package exchanging device and are transported and supplied to a spindle of the two-for-one twisting machine.

25 Claims, 11 Drawing Sheets

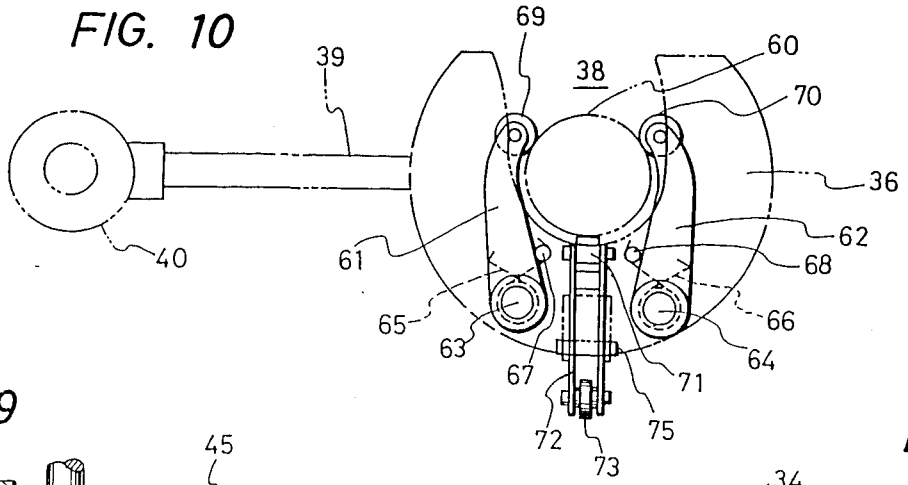
FIG. 10
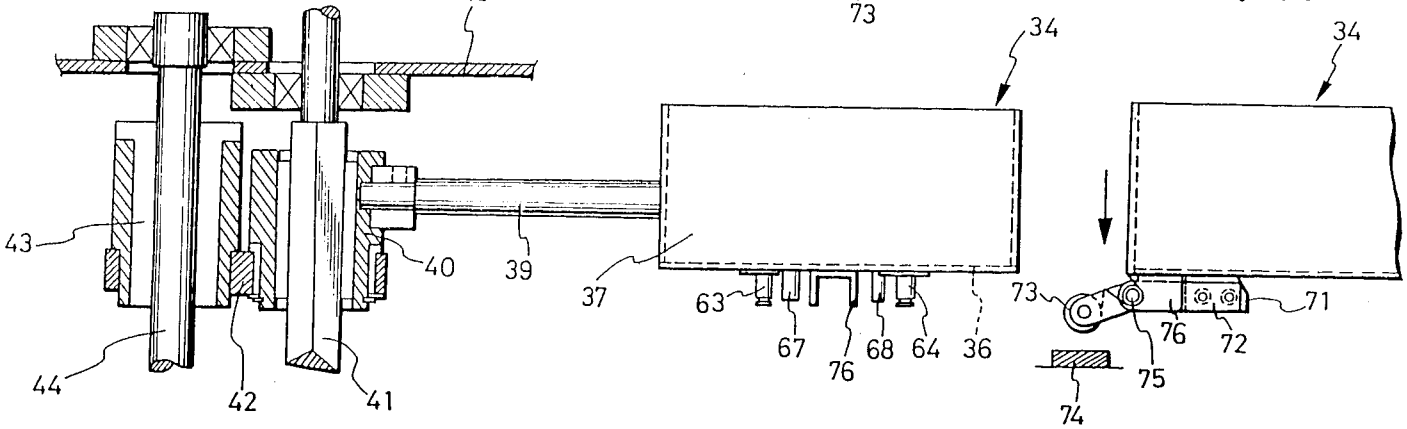
FIG. 11
FIG. 9

FIG. 14
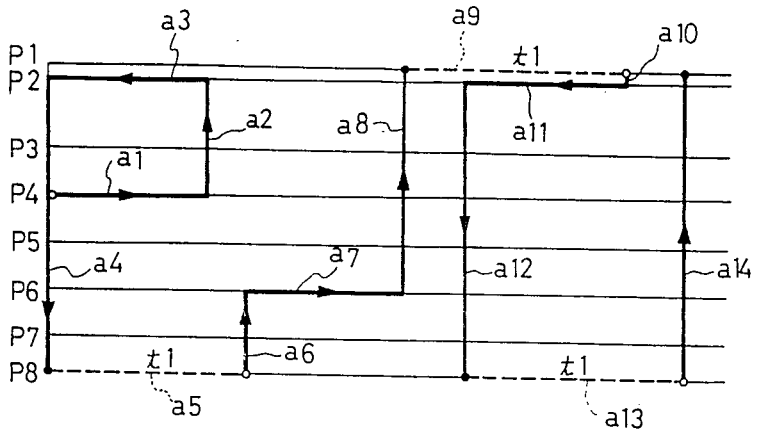
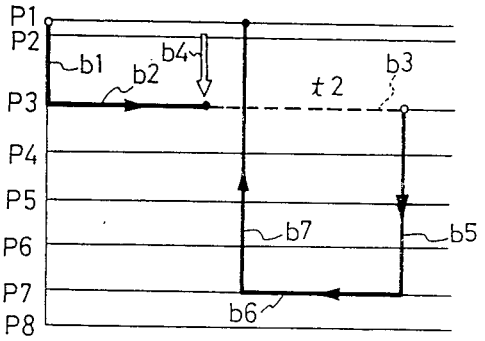
FIG. 15
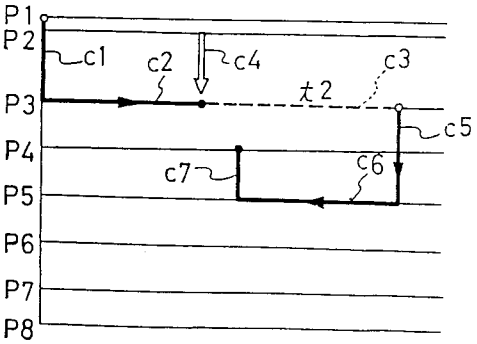
FIG. 16

INTERCONNECTING SYSTEM FOR A WINDER AND A TWO-FOR-ONE TWISTING MACHINE

FIELD OF THE INVENTION

This invention relates to an interconnecting system for an automatic winder for rewinding bobbins produced on a spinning frame and tow-for-one twisting machine.

RELATED ART STATEMENT

Wound yarn packages produced on an automatic winder are subsequently processed in different manners depending upon applications thereof. For example, yarns once drawn out from two packages are doubled into a single yarn and taken up to another package which is then supplied as a yarn supply package to a two-for-one twisting machine on which the yarn is made into a yarn having a uniform thickness or is twisted in order to increase the strength of the yarn or else fluff is twisted into the yarn in order to make yarn having a very smooth surface.

Further, for the object of omitting a doubling step between a winder and a two-for-one twisting machine, it is sometimes employed that two stage yarn supply packages disclosed in Japanese Utility Model Publication No. 61-33006 are supplied to a two-for-one twisting machine in order to double and twist them.

A two stage yarn supply package to be supplied to such a two-for-one twisting machine as described above includes a set of two packages arranged in two upper and lower stages. Such a two stage yarn supply package prepared in advance is exchanged by an operator for an empty package on a spindle on which yarn has been fully wound. Accordingly, comparing with a package obtained after passing a doubling machine as a yarn supply, such a two stage yarn supply package is difficult to handle due to its great height. Consequently, the operation for exchanging a yarn supply package is troublesome, and much time is required for exchanging of yarn supply packages on an entire two-for-one twisting machine which is constituted from a large number of spindles.

OBJECT AND SUMMARY OF THE INVENTION

It is an object of the present invention to provide a system in which an automatic winder and a two-for-one twisting machine for two stage yarn supply packages are connected to each other such that a package doffed on the winder may be supplied directly to the two-for-one twisting machine.

The present invention provides a system for interconnecting an automatic winder and a two-for-one twisting machine for two stage yarn supply packages, wherein a package exchanging device is located between the automatic winder and the two-for-one twisting machine such that packages which are conveyed on a package transporting conveyor on the automatic winder side are fed to the package exchanging device and are transferred to a yarn supply package feeding path on the two-for-one twisting machine side by the package exchanging device to be a set of two packages arranged in two upper and lower stages.

BRIEF DESCRIPTION OF THE DRAWINGS

FIG. 9 is a front elevational view showing a receiving member 34 of the package exchanging device of FIG. 6;

FIG. 10 a plan view of the package exchanging device of FIG. 6;

FIG. 11 a side elevational view of the package exchanging device of FIG. 6;

FIGS. 14 to 16 are schedule views showing an operation of the receiving member of the package exchanging device, and FIG. 14 being a view of the first step, FIG. 15 a view of the second step, FIG. 16 a view of the third step;

DETAILED DESCRIPTION OF PREFERRED EMBODIMENTS

Now, embodiments of the present invention will be described with reference to the drawings.

Figure 1:
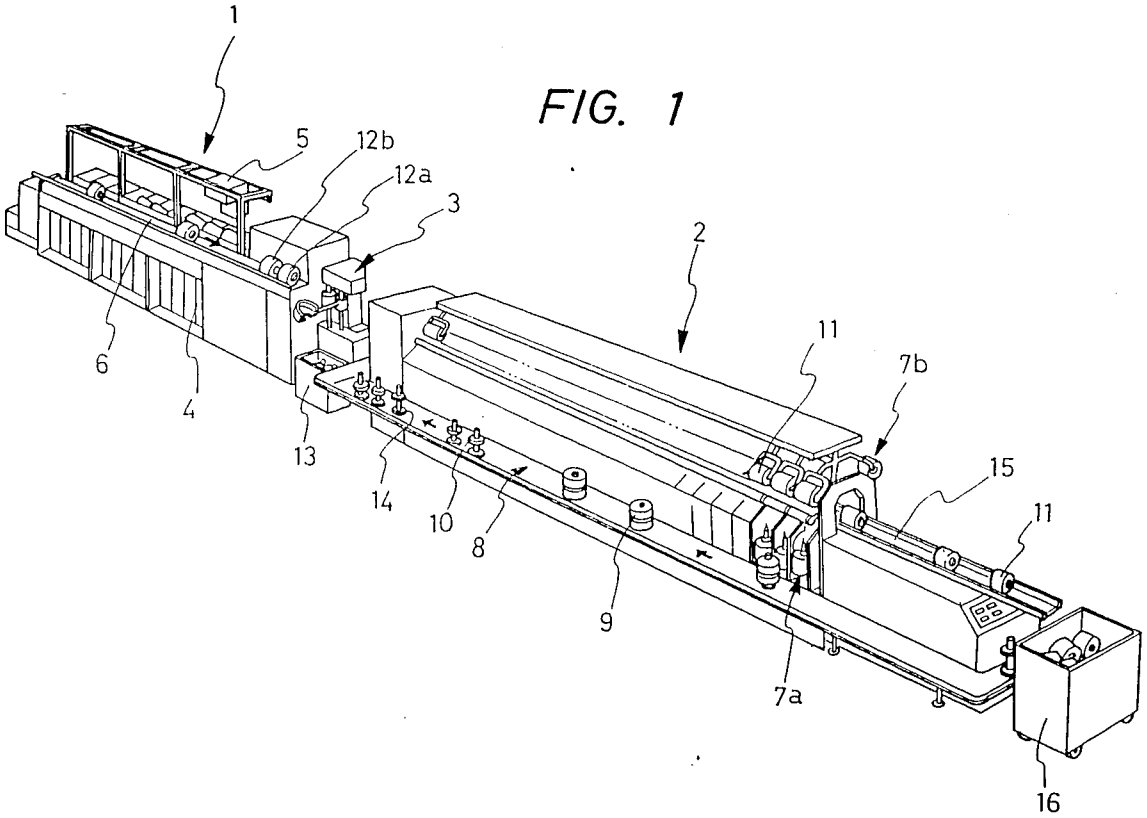
FIG. 1 is a perspective view of general construction showing a first embodiment of a system of the present invention.

FIG. 1 shows a first embodiment of a system of the present invention wherein an automatic winder 1 and a two-for-one twisting machine 2 are connected directly to each other by a package exchanging device 3.

The automatic winder 1 is constituted from a plurality of winding units 4. Packages produced on the individual winding units and having yarns of a predetermined length thereon are doffed by an automatic doffing truck 5 which can travel along the units and are then delivered onto a package transporting conveyor 6 extending along the units.

Meanwhile, the two-for-one twisting machine 2 connected directly to the winder 1 is constituted from a large number of spindles *7a* and *7b* arranged in a back to back juxtaposed relationship to each other. A yarn supply package feeding conveyor 8 extends in a closed loop around a stand of the yarn doubling and twisting machine 2. Yarn supply packages 9 of the two stage type and empty yarn supports 10 are fed in a mixed condition on the conveyor 8, and when rewinding is completed on a spindle, either an operator or an operating robot will operate to cause a fully wound package 11 to be delivered from the spindle and to exchange an empty yarn support within the spindle for a yarn supply package on the conveyor. After then, rewinding will be started again.

The package exchanging device 3 which will be hereinafter described is interposed between the winder 1 and the two-for-one twisting machine 2. The package exchanging device 3 pulls an empty yarn support 10 fed thereto on the conveyor 8 off a package transport medium (hereinafter referred to as tray 14) and supplies and fits fully wound packages 12*a* and 12*b* fed thereto from the winder side onto the tray 14. Reference numeral 13 denotes an empty bobbin box in which empty bobbins pulled off trays 14 are stored.

It is to be noted that, in FIG. 1, a fully wound package 11 doffed on the two-for-one twisting machine 2 is delivered onto a conveyor belt 15 which travels between the spindles arranged in a back to back relationship and is then placed into a package storing truck 16 positioned sidewardly of the stand of the two-for-one twisting machine.

Further, while in the present embodiment a single winder and a single two-for-one twisting machine are shown connected to each other, naturally it is possible to interconnect a single winder and a plurality of two-for-one twisting machines, or to interconnect a plurality of winders and a single two-for-one twisting machine, or else to interconnect a plurality of winders and a plurality of two-for-one twisting machines, by means of a common transport path. Generally, the running speed of yarn on a two-for-one twisting machine is very low comparing with the running speed of yarn on a winder, and for example, the yarn running speed on a two-for-one twisting machine is 30 to 70 m/min while the yarn running speed on a winder is 1000 m/min. Accordingly, for example, for a winder which includes up to 8 winding units on which the yarn speed is 1000 m/min, up to 133 spindles on which the yarn running speed is 30 m/min provide a good balance in the ratio of production.

Figure 2:
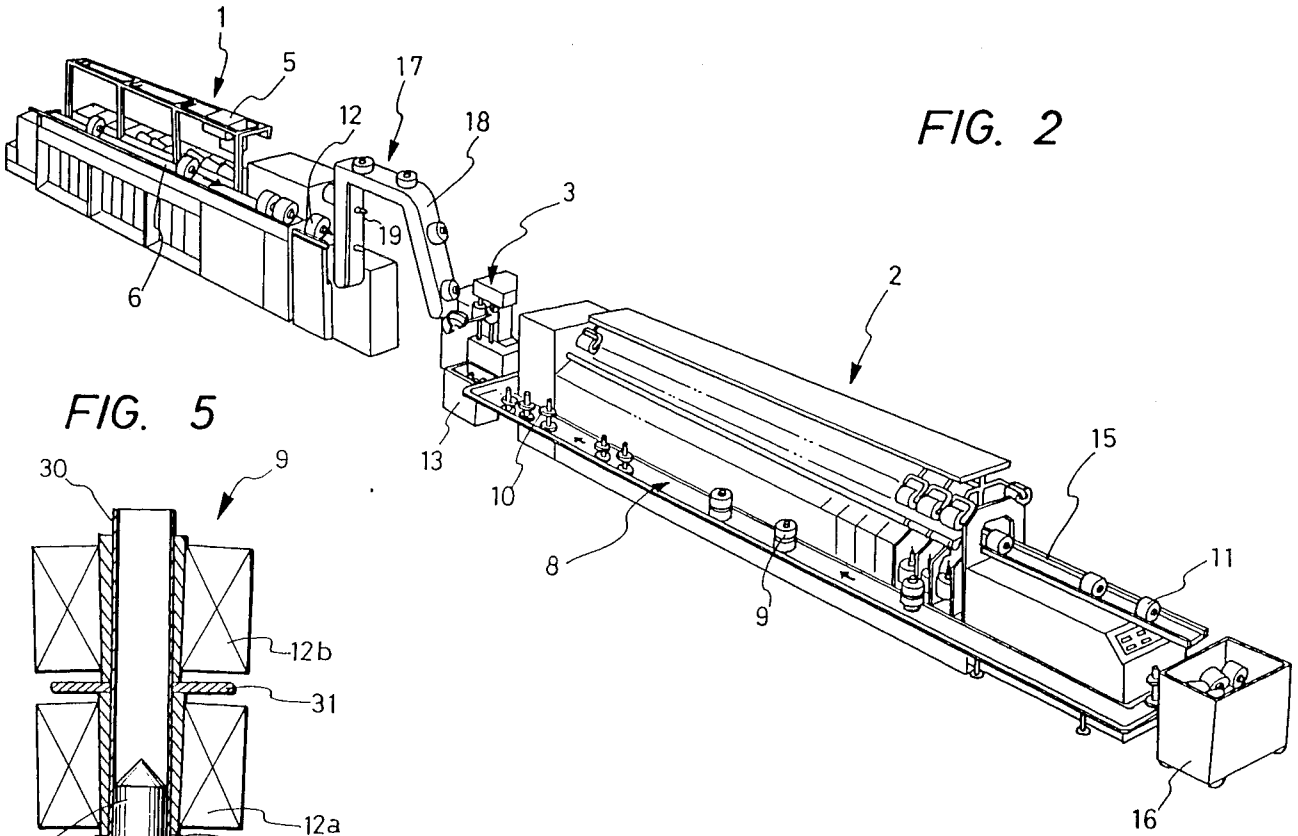
FIG. 2 a perspective view of general construction showing a second embodiment.

FIG. 2 shows a second embodiment of a system of the present invention wherein a winder 1 and a two-for-one twisting machine 2 are connected to each other by a gate conveyor 17 and a package exchanging device 3 located therebetween. The winder and the two-for-one twisting machine 2 are similar to those of the first embodiment described above. The gate conveyor 17 includes an endless belt 18 on which package supporting pegs 19 are securely mounted in a predetermined pitch and travels along a path of an inverted U-shape. The gate conveyor 17 thus receives a package 12 on the winder side and transfers it to the package exchanging device 3.

In the present embodiment, an operator can pass between the winder 1 and the two-for-one twisting machine 2, and a plurality of packages can be reserved on the gate conveyor 17.

Figure 3:
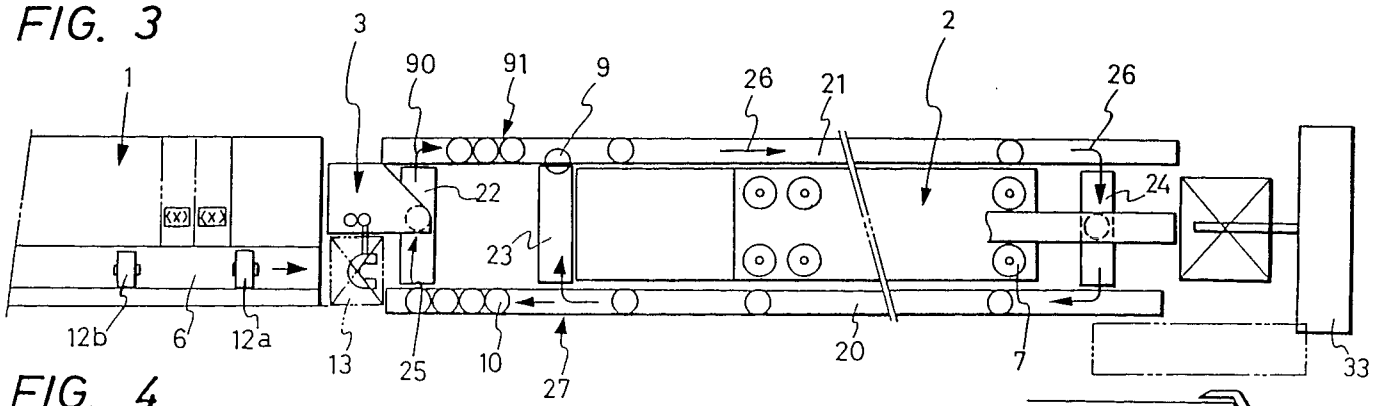
FIG. 3 a plan view of general construction showing a third embodiment.
Figure 4:
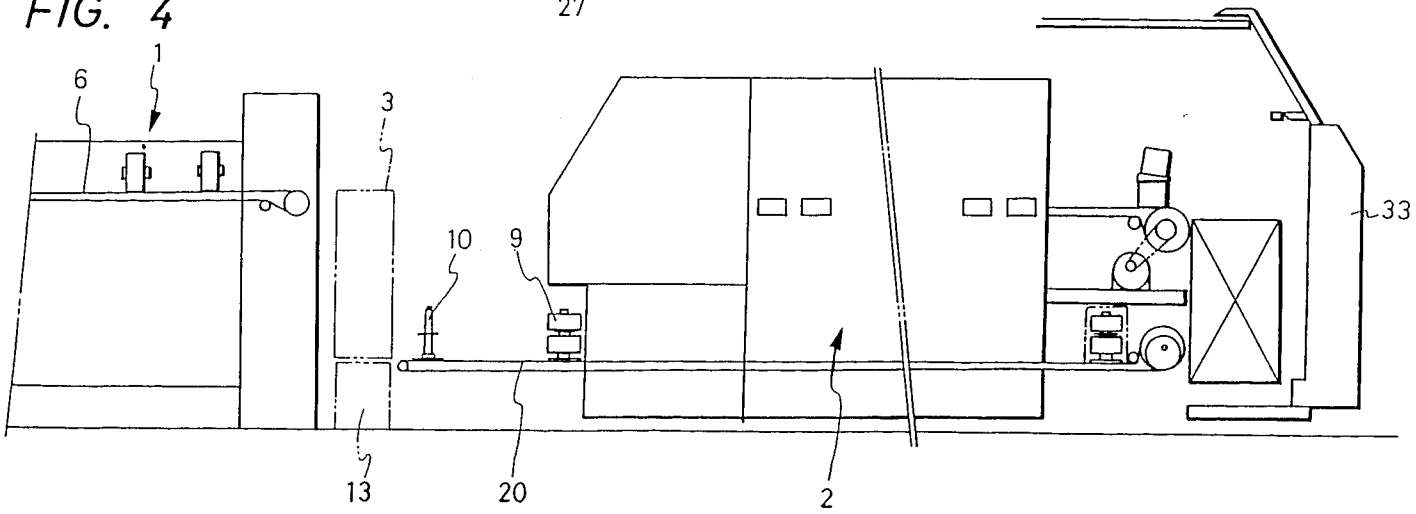
FIG. 4 a front elevational view of the embodiment of FIG. 3.

FIGS. 3 and 4 show a modification to the system shown in FIG. 1 wherein the yarn supply transport path on the two-for-one twisting machine side is modified and an automatic doffing truck 33 is disposed. In particular, conveyors 22, 23 and 24 extend between a pair of conveyors 20 and 21 which extend along spindles 7*a* and 7*b* of a two-for-one twisting machine 2, and a package exchanging station 25 is located at an intermediate position of the conveyor 22. Accordingly, fully wound packages and empty yarn supports are fed in a mixed condition in a direction indicated by an arrow mark 26 on the conveyors 21, 24 and 20, and at a branch point 27, the fully wound packages 9 and the empty yarn support 10 are sorted so that only the fully wound packages are fed onto the conveyor 23 while the empty yarn support 10 are fed straightforwards on the conveyor 20 until they are supplied to the package exchanging station 25.

Figure 5:
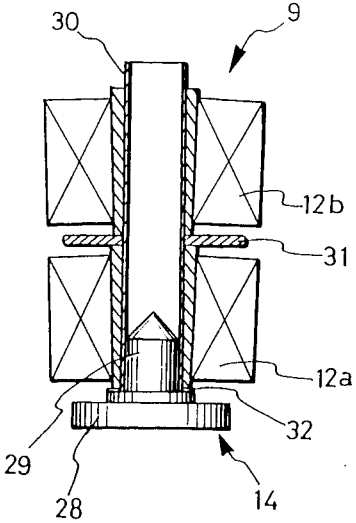
FIG. 5 a sectional view showing an example of a two stage yarn supply package.

In FIG. 5, there is shown a two stage yarn supply package 9 to be fed on the conveyor on the two-for-one, twisting machine side of the systems described above. In particular, the yarn supply package includes a substantially cylindrical package supporting member 30 fitted on a peg 29 of a tray 14 which is formed on a disk member 28 of the tray 14, a lower stage package 12 and an upper stage package 12fitted on the supporting member 30, and a yarn guide plate 31 in the form of a disk fitted between the packages 12*a* and 12*b*. A flanged portion 32 for supporting a bobbin thereon is formed at a lower end of the supporting member 30. Accordingly, if a yarn supply package comprised of the supporting member 30, packages 12*a* and 12*b* and guide plate 31 is pulled off the peg 29 by a hand grasping at an upper end portion of the supporting member 30, it is pulled off as a unitary body and can thus be supplied to a spindle of the two-for-one twisting machine.

Figure 6:
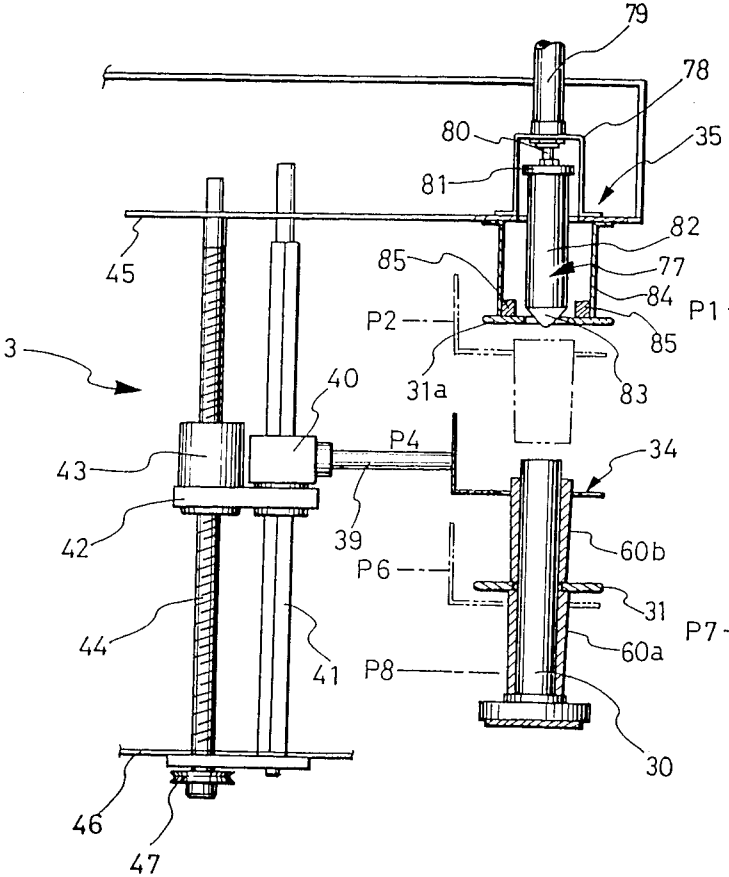
FIG. 6 a front elevational view showing a package exchanging device.

Now, the package exchanging device 3 described above will be described with reference to FIGS. 6 to 12. Referring to FIG. 6, the exchanging device 3 is constituted from a package receiving member 34 mounted for sliding movement in up and down directions and for pivotal motion, and a guide device 35 for positioning and guiding a package when the package is to be fitted on the cylindrical supporting member 30 on a tray.

The package receiving member 34 includes, as shown in FIGS. 9 and 10, a bottom wall 36 for receiving and supporting an end face of a layer of yarn of a package and a side wall 37 and has a configuration of a box wherein one side of a groove 38 which is formed on one side of the side wall and also in the bottom wall 36 is opened.

An arm 39 is securely mounted at an end thereof on the side wall 37 of the receiving member 34 while the other end of the arm 39 is securely mounted on a side portion of a hub 40. The hub 40 is mounted for movement only in up and down directions on and relative to a spline shaft 41 and is supported for integral rotation with the shaft 41 on a liftable member 42. Further, a nut member 43 is secured to the liftable member 42 so that as a threaded rod 44 held in threaded engagement with the nut member 43 is rotated, the liftable member 42 and the hub 40 supported for rotation on the liftable member 42 are moved up or down. In particular, the threaded rod 44 is rotated forwardly and reversely by a motor not shown and a pulley 47 secured to a lower end of the threaded rod 44 and is supported for rotation between upper and lower frames 45 and 46 as shown in FIG. 6 so that the liftable member and hence the receiving member 34 are moved up and down. At each of stopping positions (8 positions in the present embodiment), a contactless switch is provided, and stopping control is effected upon detection of a portion of the liftable member 42 by such a contactless switch.

Figures 12, 13:
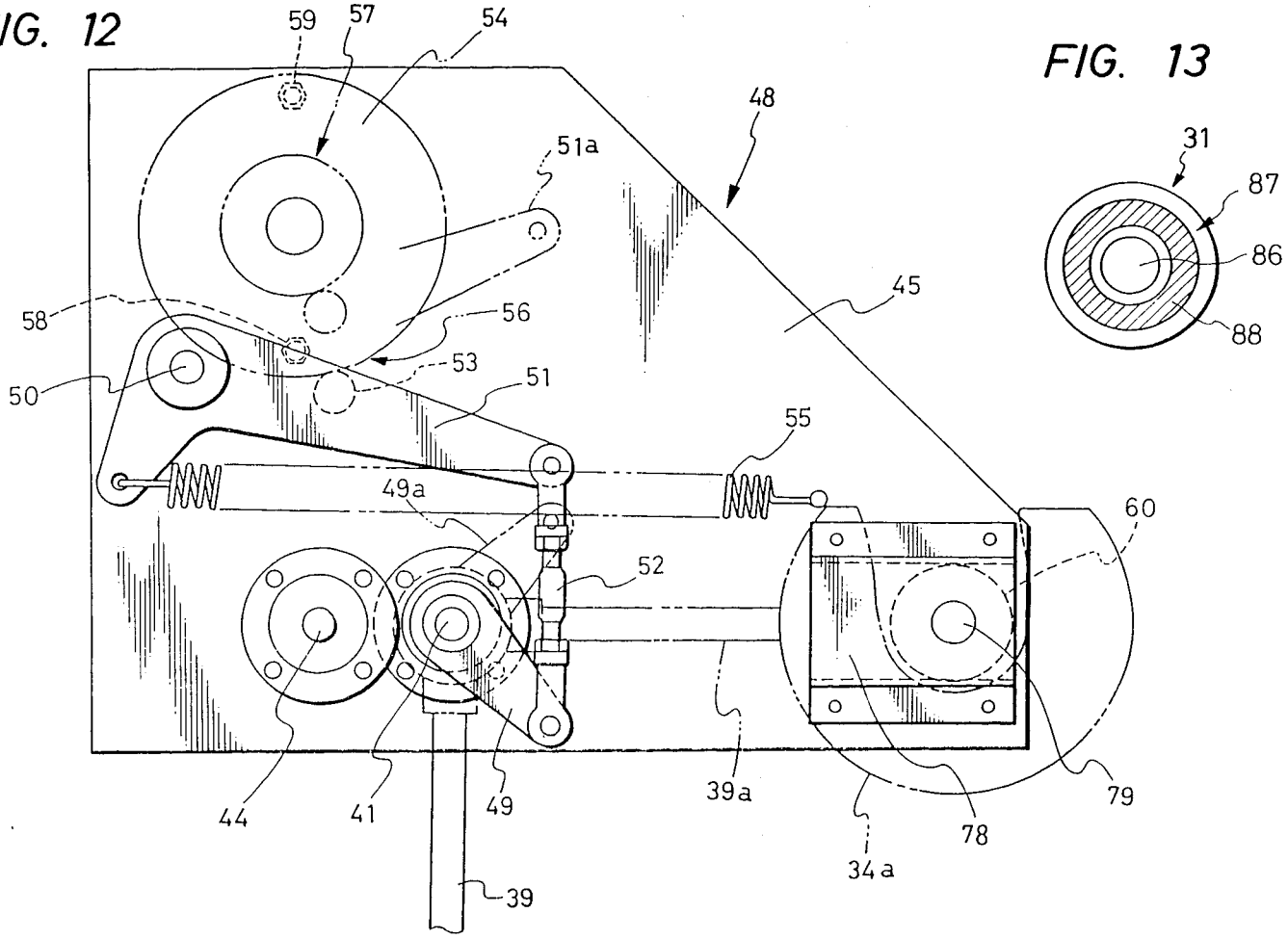
FIG. 12 a plan view showing a pivotal driving mechanism for the receiving member.
FIG. 13 a plan view showing an intermediate guide plate of the two stage yarn supply package.

Meanwhile, pivotal motion of the arm 39 is caused by the spline shaft 41 and the hub 40 fitted around the spline shaft 41. A driving mechanism 48 for the spline shaft 41 is shown in FIG. 12. In particular, a lever 49 is keyed to an upper end of the spline shaft 41, and a rod 52 is connected between the lever 49 and a cam lever 51 supported for pivotal motion on a fixed shaft 50. A cam follower 53 is carried at an intermediate portion of the cam lever 51 and is contacted under pressure by a force of a spring 55 with the cam plate 54 which is driven by the motor. A cam face 56 of a maximum radius and another cam face 57 of a minimum radius are formed in a spaced relationship in phase by 180 degrees on the cam plate 54. Accordingly, as the cam lever 51 is pivoted between a solid line position and a two dot chain line position 51*a*, the lever 49 secured to the spline shaft 41 is moved between a solid line position and a two dot chain line position 49*a*. In the case of the present embodiment, the solid line position of the lever 49 is a position in which the receiving member accepts a package from the winder side and an empty bobbin gripped by the receiving member is released from the receiving member. On the other hand, at the two dot chain line position 49*a* of the lever 49, the receiving member 34 is at a two dot chain line 34*a* position which is a position in which the receiving member 34 grips an empty bobbin positioned on a tray and a package on the receiving member is supplied onto a tray. The angle between the positions 49 and 49*a* is 90 degrees. Reference numerals 58 and 59 denote each a contactless switch for detecting the cam plate 54 at either of positions rotated by 180 degrees. Each of the contactless switches 54 detects an end face of the larger radius portion of the cam plate and thus causes the arm to temporarily stop its pivotal motion.

The groove 38 into which a bobbin 60 can be relatively received is formed in the bottom wall 36 of the receiving member 34 as shown in FIGS. 9 to 11, and a pair of empty bobbin gripping pieces 61 and 62 are supported at 63 and 64, respectively, for rotation on a lower face of the bottom plate 36 on opposite sides of the groove 38. The empty bobbin gripping pieces 61 and 62 are urged in a direction to grip an empty bobbin 60 therebetween by a pair of coil springs 65 and 66 extending around the shafts 63 and 64, respectively, and are stopped by a pair of stoppers 67 and 68 to define limit positions of pivotal motion of the empty bobbin gripping pieces 61 and 62. A pair of rollers 69 and 70 are supported at ends of the gripping pieces 61 and 62 for pressing against and gripping an empty bobbin therebetween.

Further, a pressing piece 71 for effecting gripping and releasing of an empty bobbin is screwed to an end of a lever 72 at a position corresponding to the most interior of the groove 38, and as a cam roller 73 at an end portion of the lever 72 supported on a shaft 75 of a bracket 76 is engaged by a cam piece 74 provided on the fixed frame side corresponding to a location near a most lowered position of the receiving member, the pressing piece 71 integral with the lever 72 is pivoted in the clockwise direction around a fulcrum provided by the shaft 75. Accordingly, the pressing piece 71 which provides one of three gripping points for an empty bobbin, that is, one of three gripping points provided by the rollers 69 and 70 and the pressing piece 71 of FIG. 10, is moved out of position, and consequently the empty bobbin 60 is dropped.

Further, in FIG. 6, a guide rod 77 for a package positioned on an axial line of the supporting member 30 is mounted for up and down movement above a tray 14 at the position of the package exchanging device 3. In particular, the guide rod 77 has a flanged portion 81, a cylindrical portion 82 and a conical portion 83 formed in an integral relationship thereon and is securely mounted on a piston rod 80 of a hydraulic cylinder 79 located on a fixed frame 78. Thus, by an action of the cylinder 79, the guide rod 77 is moved up and down between a stand-by position 77 and a most lowered position 77*a* shown in two dot chain lines in FIG. 8. The most lowered position of the guide rod 77 is a position in which the conical portion at the lower end of the guide rod 77 is fitted a little into an opening at an upper end of the cylindrical supporting member 30 on a tray.

Figure 7:
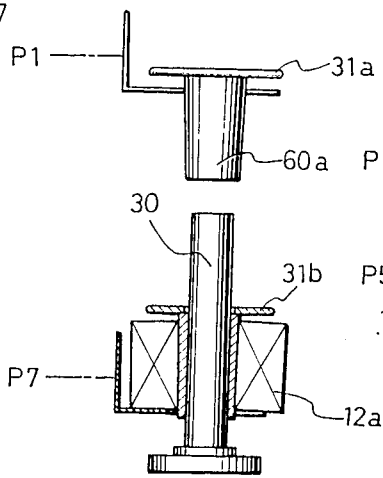

It is to be noted that a magnet 85 is secured to a plate 84 depending from the frame 45 of FIG. 6 and attracts and holds thereto the guide plate 31*a* at an intermediate portion of a two layer yarn supply. In particular, as the guide plate 31 is pulled off simultaneously when an empty bobbin 60*a* at the lower stage is pulled off and is then lifted to its most lifted position 31*a*, only the guide plate 31*a* is attracted to the magnet 85 as shown in FIG. 7. On the other hand, when the guide plate 31*a* is to be fitted onto the supporting member 30, the flanged portion 81 pushes the guide plate 31*a* downwardly and compulsorily removes the same from the magnet 85 when the guide rod 77 is moved down. It is to be noted that, as shown in FIG. 13, the guide plate 31 has a hole 86 formed therein through which the supporting member 30 can extend while an iron ring 88 adapted to be attracted by the magnet 85 is embedded in an upper wall 87 of the guide plate and the other portion is formed from a material having a suitable wear resisting property to feeding of yarn such as a synthetic resin or a ceramic. Further, bobbins 60*a* and 60*b* are formed from a material such as a plastic or paper.

Now, operation of the package exchanging device 3 described above will be described with reference to FIGS. 6 to 8 and 14 to 16.

Figure 8:
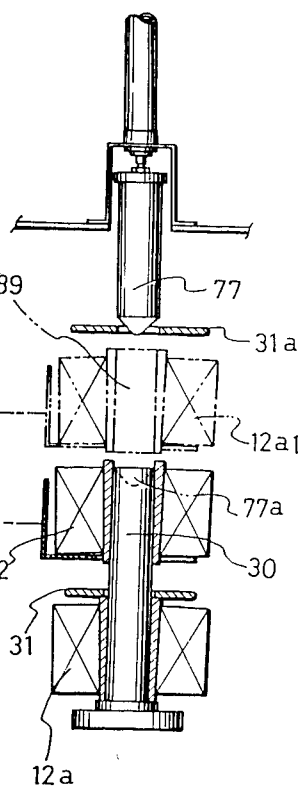
FIGS. 7 and 8 are schematic illustrations showing a package exchanging operation.

It is to be noted that positions P1 to P8 in the following description indicate positions in up and down directions of the receiving member 34, and the positions P1 to P8 of FIGS. 14 to 16 correspond to the positions P1 to P8 of FIGS. 6 to 8, and wherein the position P1 is the most lifted position and the position P8 is the most lowered position.

At first, in the layout of FIGS. 3 and 4, an empty yarn support 10 is stopped and positioned at the exchanging station 25.

A package exchanging operation is comprised of three steps. In particular, a package exchanging operation includes a first step of pulling off an empty bobbin on a tray, a second step of fitting a package at the lower stage onto the supporting member 34, and a third step of fitting a package at the upper stage onto the supporting member 34.

FIG. 14 illustrates the first step described above. In particular, the receiving member 34 is pivoted as at al by 90 degrees from its stand-by position at the height P4 and grips thereon an empty bobbin 60*b* at the upper stage. Then, the receiving member 34 is lifted as at a2 to the height P2 to pull off the empty bobbin 60*b* from the supporting member 30 and is then turned reversely as at a3 by 90 degrees again whereafter it is moved down as at a4 to the most lowered position P8. At the most lowered position, the cam piece 74 is located as shown in FIG. 11 and releases the pressing piece 71. Consequently, the empty bobbin 60*b* which has been gripped on the receiving member 34 drops and is thus put into the box (13 in FIG. 3) below. In the meantime, after stopping as at a5 for a time t1, the receiving member 34 is moved up as at a6 to the height P6 and then pivoted as at a7 by 90 degrees to grip thereon an empty bobbin 60*a* at the lower stage. Then, as the receiving member 34 is lifted as at a8 to the most lifted position, the intermediate guide plate 31 and the empty bobbin 60*a* at the lower stage are pulled off in an integral relationship, and then when they are lifted to the most lifted position as shown in FIG. 7, the guide plate 31*a* is attracted to the magnet 85. After stopping as at a9 of the time t1, the receiving member 34 is lowered as at a10 to the P2 position and the guide plate 31*a* and the empty bobbin 60*a* are separated from each other whereafter the receiving member 34 is turned reversely as at all by 90 degrees and then lowered as at 12 to the most lowered position P8 to cause the empty bobbin 60*a* to be dropped and put into the box 13 by a similar operation to that described above. After stopping as at a13 of the time t1, the receiving member 34 is lifted as at a14 to the most lifted position P1 again in order that a new package may be supplied thereto from the winder.

Subsequently, referring to FIG. 15 illustrating the second step, the receiving member 34 which has accepted therein a package to be fitted into the lower stage at the P1 position is lowered as at b1 to the P3 position and is then pivoted as at b2 whereafter it is held stopped as at b3 for a time t2 at a package fitting position above a tray. Within the time t2, the guide rod 77 shown in FIG. 6 is lowered as at b4 until it assumes a two dot chain line position 77*a* of FIG. 8 wherein the lower end thereof is a little fitted into the supporting member 30. In this instance, since the guide rod 77 is lowered passing through a center hole 89 of a package 12*a*1 in a stand-by condition of FIG. 8, the center hole 89 of the package and the supporting member 30 are corrected in position on a same axial line. Accordingly, the receiving member 34 is subsequently lowered as at b5 to the position P7 so that a package 12a2 at the lower stage is positioned to a position of FIG. 7. As the receiving member 34 is turned reversely as at b6, the package 12*a*2 and the receiving member 34 are separated from each other so that the package 12a2 fitted on the supporting member is dropped to the lowermost stage 12*a* by its own weight. It is to be noted that as the guide rod 77 is lowered as at b4, the guide plate 31*a* which has been held attracted to the magnet 85 is compulsorily pushed downwardly by the flanged portion 81 of the guide rod and thus moved away from the magnet 85 so that it is slipped down along the cylindrical portion 82 of the guide rod 77 until it is placed onto an upper end of the package 12a1 at the stand-by position. As the receiving member 34 is lowered as at b5 in this condition, the intermediate guide plate 31*b* can be fitted to a position above the package 12*a*2 at the lower stage as shown in FIG. 7.

After the receiving member 34 is turned reversely as at b6, it is lifted as at b7 to the most lifted position, thereby completing supply of a package to the lower stage.

Subsequently, when a package to be fitted to the upper stage is supplied from the winder side onto the receiving member 34 at the P1 position, the third step illustrated in FIG. 16 is started. The receiving member 34 which has received a package at the P1 position is then lowered as at c1 to the P3 position and then pivoted as at c2 whereafter it is held stopped as at c3 for the time t2 at a two dot chain line position of FIG. 8. Within the time t2, the guide rod 77 is lowered as at c4 so that the axis of the package on the receiving member is adjusted in a similar manner as in the second step. Subsequently, the receiving member 34 is lowered as at c5 to the P5 position of FIG. 8 and then turned reversely as at c6 whereafter it is moved up as at c7 to the stand-by position P4, thereby completing the third step. As the receiving member 34 is turned reversely, a package 12*b*2 at the upper stage of FIG. 8 is slipped down along the supporting member 30 until it is placed onto the guide plate 31, thereby assembling a two stage yarn supply package 9 shown in FIG. 5. It is to be noted that, in the foregoing description, the times t1 and t2 which are set as stopping times for the receiving member are set suitably and thus set, for example, to t1=0.5 seconds and t2=1 second, respectively.

A two stage yarn supply package is exchanged at the yarn supply package exchanging station 25 of FIG. 3 in such a manner as described above and is then fed in a direction indicated by an arrow mark 90. Then, after such two stage yarn supply packages are reserved once as at 91, they are forwarded one after another so that they may be spaced by a substantially fixed distance on the conveyor 21. Such yarn supply packages which are circulated around the two-for-one twisting machine are exchanged for empty yarn supports on the spindles of the two-for-one twisting machine either by an operator or by the doffing truck 33 or the like.

It is to be noted that since in a two-for-one twisting machine of the two stage yarn supply packages type higher tension is applied to a segment of yarn drawn out from a package at the lower stage than that to a segment of yarn drawn out from another package at the upper stage so that there is a tendency that the yarn from the lower stage be extended, where packages at the upper and lower stages have a same amount of yarn thereon, some amount of the yarn supply at the lower stage may remain even after the yarn supply at the upper stage has been completely released. Accordingly, in order to reduce such a remaining amount of yarn, it is necessary to supply to the lower stage a package having thereon a somewhat smaller amount of yarn than that of a package to be supplied to the upper stage. Therefore, on the winder 1 side, it is desired to transport a set of packages 12*a* and 12*b* having different amounts of yarn thereon to the exchanging device side. Thus, the doffing device is controlled such that two different types of packages may be placed alternately in a regular order on the transporting conveyor 6 of FIG. 3.

A winder may be substantially divided into two winding zones, and packages having a smaller amount of yarn thereon are produced in the first winding zone while packages having a greater amount of yarn thereon are produced in the second winding zone. A package doffed in the first winding zone and another package doffed in the second winding zone are caused to make a group, and such groups of packages are transported in a predetermined order.

Now, an embodiment of the above-mentioned control system for doffing packages will be described with reference to the drawings.

Figure 21:
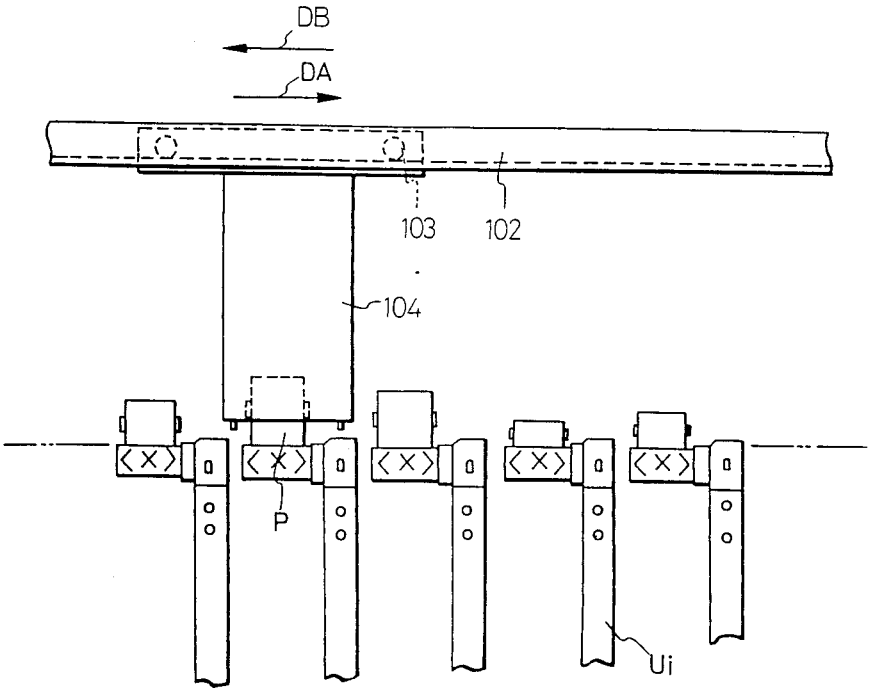
FIG. 21 a front elevational view showing a relation between the automatic winder and a doffing truck.
Figure 22:
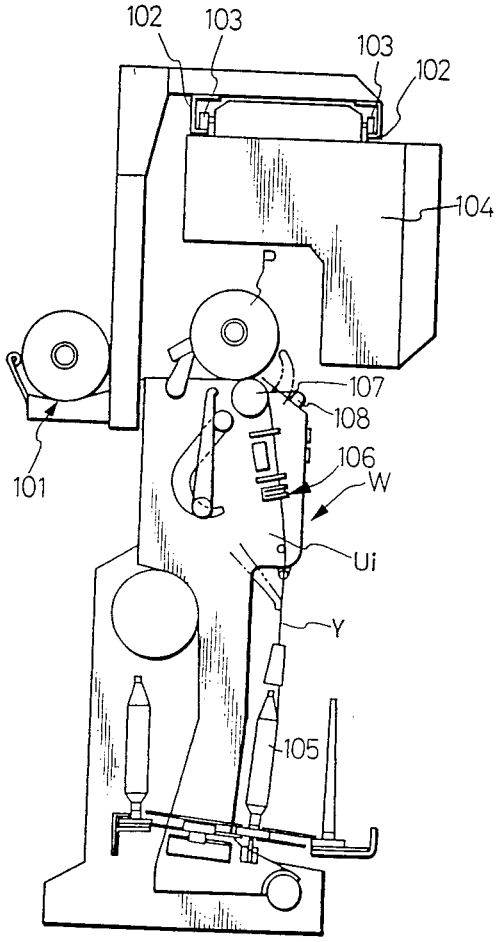
FIG. 22 a side elevational view of the relation of FIG. 21.

An example of automatic winder is shown in FIGS. 21 and 22. The automatic winder W is constituted from a large number of winding units Ui arranged in a juxtaposed relationship to each other, and a conveyor belt 101 for transporting a fully wound package thereon extends along a side of a row of the winding units. Further, a pair of ceiling rails 102 extend along and above the winding units, and a doffing truck 104 is supported on and depends from the ceiling rails 102 by way of wheels 103 and is moved in a direction indicated by an arrow mark DA or DB in FIG. 21. The doffing truck 104 is stopped at a position of a winding unit which has a fully wound package P thereon and performs an automatic doffing operation to deliver the fully wound package on the unit onto the conveyor belt 101.

On each winding unit Ui, yarn Y released from a spinning bobbin 105 passes through a known yarn clearer 106 and is then wound onto a package P being rotated by a traverse drum 107 while being traversed as shown in FIG. 22. After a preset amount of yarn is wound up by means of a metering mechanism which is provided for each winding unit or for a winding stand, a full wind signal is developed from the metering mechanism so that a full wind lamp 108 is lit and the doffing truck 104 is operated to perform a doffing operation in response to an instruction from a controlling device which will be hereinafter described.

Figure 17:
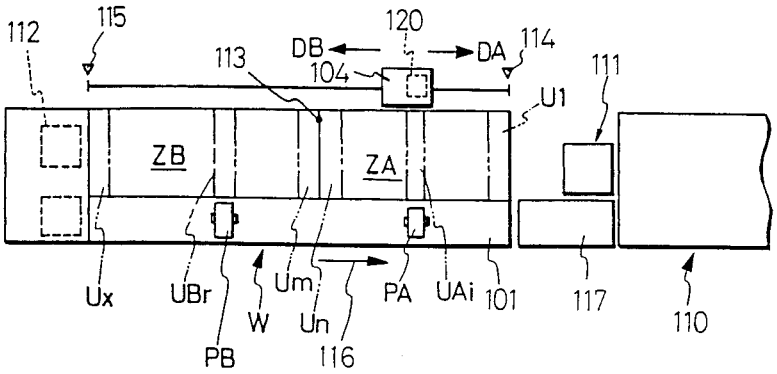
FIG. 17 a plan view of general construction of an automatic winder.

Further, in the present embodiment, the automatic winder described above is connected to a two-for-one twisting machine 110 of the two stage yarn supply type as shown in FIG. 17. Thus, the winding units are substantially divided into two winding zones ZA and ZB wherein the units Ul to Un constitute the zone ZA and produce packages PA having a smaller amount of yarn thereon while the units Um to Ux constitute the other zone ZB and produce packages PB having a greater amount of yarn thereon.

Figure 20:
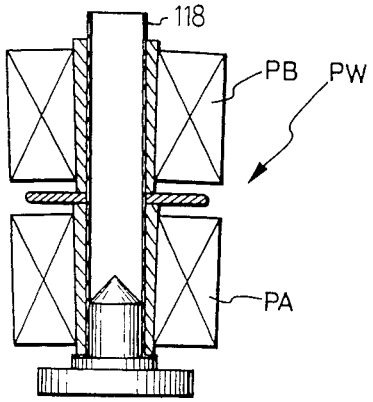
FIG. 20 a sectional view showing an example of the two stage yarn supply package.

Located between the winder W and the two-for-one twisting machine 110 is a yarn supply package exchanging device 111 which assembles a package PA fed thereto on the conveyor 101 from the zone ZA and another package PB from the zone ZB into a two stage yarn supply package PW shown in FIG. 20 and exchanges the two stage yarn supply package PW for an empty yarn support fed thereto from the two-for-one twisting machine side.

Further, a controlling device 112 for controlling an operating timing of the doffing truck 104, an operating timing of the transporting conveyor and so on is provided on the automatic winder side and operates in association with the metering device. Meanwhile, a magnet 113 for a boundary signal is located at a boundary between the zone ZA and the other zone ZB of the winder on a traveling path of the doffing truck 104, and a boundary signal detecting means such as a reed switch RS for detecting the magnet 113 is located on the doffing truck 104.

Now, operation of the doffing truck 104 and the transporting conveyor 101 will be described. Referring to FIG. 1, if a winding unit UAi from which a doffing instruction is being developed is detected during traveling of the doffing truck in a direction indicated by an arrow mark DA in the zone ZA, the truck 104 is stopped at the position of the winding unit and performs a normal doffing operation so that a fully wound package PA is delivered onto the conveyor 101. The truck 104 which has completed its doffing operation at the unit UAi starts traveling thereof in the direction of the arrow mark DA again. Then, the truck 104 is reversed at a traverse end 114 and then starts traveling thereof in a direction indicated by an arrow mark DB. During traveling of the truck 104 in the direction of the arrow mark DB, while the truck 104 is traveling in the zone ZA, even if there is a winding unit which is developing a doffing requesting instruction, the truck will pass such a winding unit without stopping, that is, without performing a doffing operation until it comes to the boundary position 13. Then, if a winding unit UBr which is developing a doffing request is detected while the doffing truck 104 is subsequently traveling in the direction of the arrow mark DB or further traveling in the direction of the arrow mark DA in the zone ZB after being reversed at an end 115 of the zone ZB, the doffing truck 104 is stopped at the position of the winding unit and performs its doffing operation.

At a point of time when a doffing operation for the unit UBr is completed, two packages PA and PB are placed on the conveyor 101 in such a juxtaposed relationship that the package PA from the zone ZA is positioned on the upstream side and the package PB from the zone ZB is positioned on the downstream side in a direction 16 of circulation of the conveyor 101. As the conveyor 101 is circulated in this condition, the packages PA and PB in pair are transported on the transporting paths 101 and 117 toward the package exchanging device 111 on the two-for-one twister side. Accordingly, if the package exchanging device 111 fits packages fed thereto on the conveyors 101 and 117 onto a holder 118 of FIG. 20 in the order of arrival there at, a desired yarn supply package WP of the two stage type is assembled with certainty wherein the package PA from the zone ZA is located at the lower stage and the package PB from the zone ZB is located at the upper stage.

During transportation of a pair of packages PA and PB on the conveyor 101, a doffing operation of the doffing truck 4 is interrupted, and after completion of the transportation of the packages PA and PB, a next doffing operation is enabled.

In particular, if a doffing request is received while the doffing truck 104 is traveling in the direction of the arrow mark DA in the zone ZB after completion of preceding transportation of packages, the truck 104 is stopped and thus performs a doffing operation at a unit from which the doffing request has been developed. During further traveling of the truck 104 in the direction of the arrow mark DA in the zone ZB, another doffing operation is blocked within the zone ZB, and at an instant when the truck 104 is advanced farther than the boundary 113 into the zone ZA, such blocking of a doffing operation is canceled so that the truck 104 will perform a doffing operation at a winding unit from which a doffing request is developed. After completion of the doffing operation, circulation of the conveyor 101 in the direction of the arrow mark 116 is started. Accordingly, also in this instance, a pair of packages PA and PB are transported toward the package exchanging device 111 while keeping a similar order to that described above.

An example of the controlling circuit for controlling such operations as described above is shown in FIG. 19. Of the circuit diagram of FIG. 19, a portion above a long and short dash line 119 indicates a controlling circuit 112 on the winder body side while the other portion below the long and short dash line 119 indicates a controlling circuit 120 provided on the truck 104, and transmission of signals between the body W and the truck 104 is effected by way of a slider cable 121.

Figure 19:
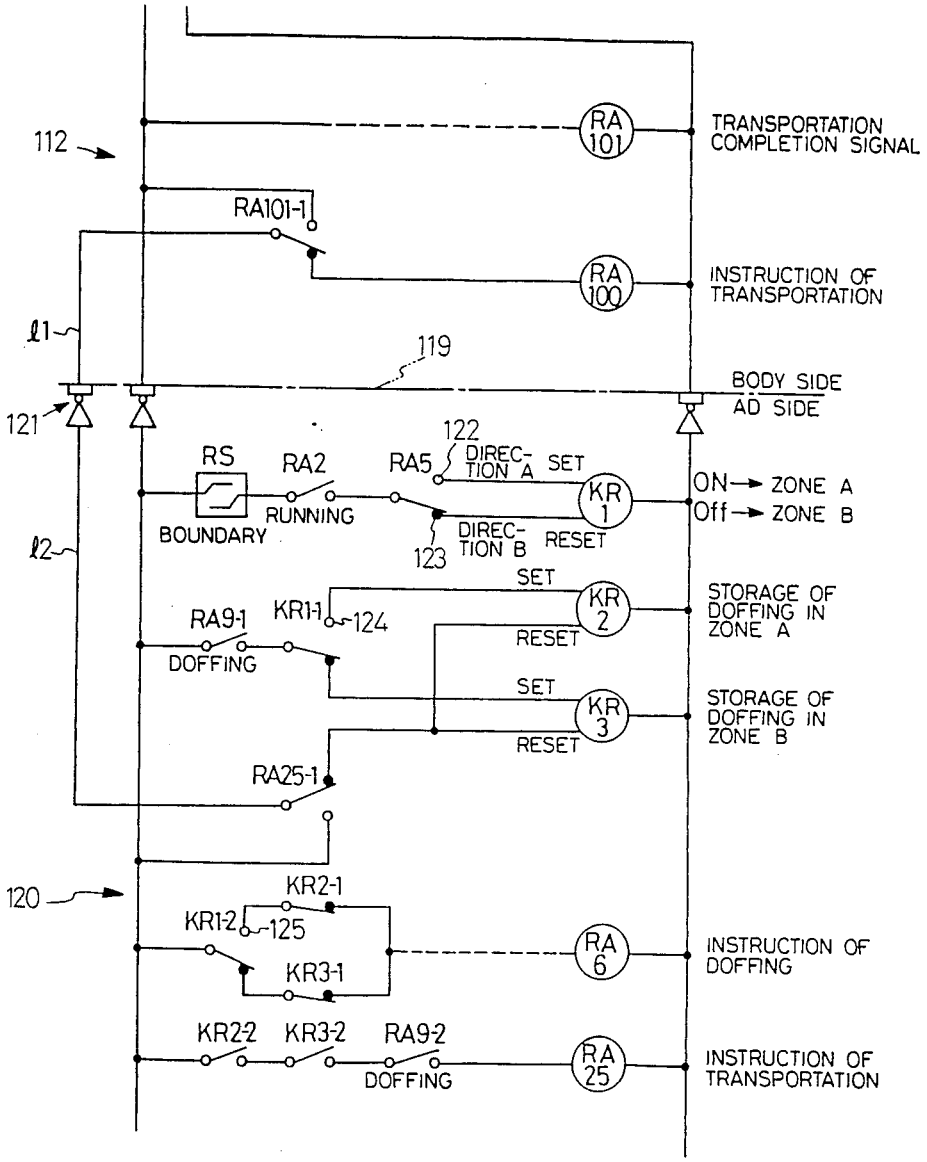
FIG. 19 a circuit diagram of a relay circuit of the embodiment of FIG. 18.

Referring to FIGS. 17 and 19, a contact RA2 is closed during traveling of the truck, and while the truck is traveling in the direction of the arrow mark DA, another contact is positioned on the white circle 122 side. When the truck crosses the boundary 113, a boundary signal is received so that the read switch RS is temporarily closed whereupon a keep relay KR1 is set. Accordingly, during subsequent traveling of the truck within the zone ZA, the keep relay KR1 maintains its on position. When the truck is reversed at the right end 114 of the zone ZA, the contact RA5 is switched to the black circle 123 side. However, since the reed switch RS is in its open position, the keep relay KR1 still maintains its on position. If the truck further travels in the direction of the arrow mark DB and then crosses the boundary 113, the reed switch RS is temporarily closed so that the keep relay KR1 is reset to its off position. Accordingly, with the circuit described above, the keep relay KR1 is kept on while the truck 104 is within the zone ZA but is kept off while the truck 104 is within the zone ZB. In other words, the first keep relay KR1 is a relay for storing a position of the truck therein.

Meanwhile, a second keep relay KR2 is a relay for storing doffing in the zone ZA therein, and a third keep relay KR3 is a relay for storing doffing in the zone ZB therein. In particular, if a doffing operation is performed in the zone ZA, two contacts KR1-1 and KR1-2 are both switched to the white circle 124 and 125 sides, respectively, and a contact RA9 which is kept on only while a doffing operation is being performed is closed so that the second keep relay KR2 is set to open a contact KR2-1 thereof for a doffing instructing circuit and close a contact KR2-2 thereof for a transportation instructing circuit.

Accordingly, even if a doffing instruction is received from the winding unit side during subsequent traveling of the truck in the zone ZA, a relay RA6 for instructing driving of the doffing device remains in its off position because the contacts KR1-2 and KR2-1 are both kept open. Accordingly, delivery of 2 packages will never occur in the zone ZA.

Then, when the truck 104 crosses the boundary and enters the zone ZB, the keep relay KR1 is reset to switch the contacts KR1-1 and KR1-2 thereof both to the black circle sides. In this condition, if a doffing operation is performed once within the zone ZB, the keep relay KR3 is turned on so that a contact KR3-1 thereof is opened and another contact KR3-2 thereof is closed. Thus, when the contacts KR2-2 and KR3-2 of the keep relays and a relay contact RA9-2 during doffing are all closed, that is, when a doffing operation is performed once in each of the zones ZA and ZB, a transportation instructing relay RA25 is turned on. As the relay RA25 is turned on, a contact RA25-1 thereof is switched to the white circle side. Consequently, a relay RA100 on the body side is turned on via lines l1 and l2 from the truck side to the body side and thus delivers a transportation instructing signal in response to which a conveyor driving motor is energized after a time lag of several seconds. In particular, a delay relay is interposed between the relay RA100 and the conveyor driving motor so that the conveyor may be circulated after completion of a doffing operation for the second time.

Then, as a transportation completion signal is developed, a relay RA101 is turned on to switch a contact RA101-1 thereof to the while circle side. At this point of time, the contact RA25-1 has been switched to the black circle side because the relay RA9-1 was turned off upon completion of a preceding doffing operation. Consequently, the set sides of the keep relays KR2 and KR3 are energized to turn the keep relays KR2 and KR3 off, thereby canceling the storage of doffing.

Figure 18:
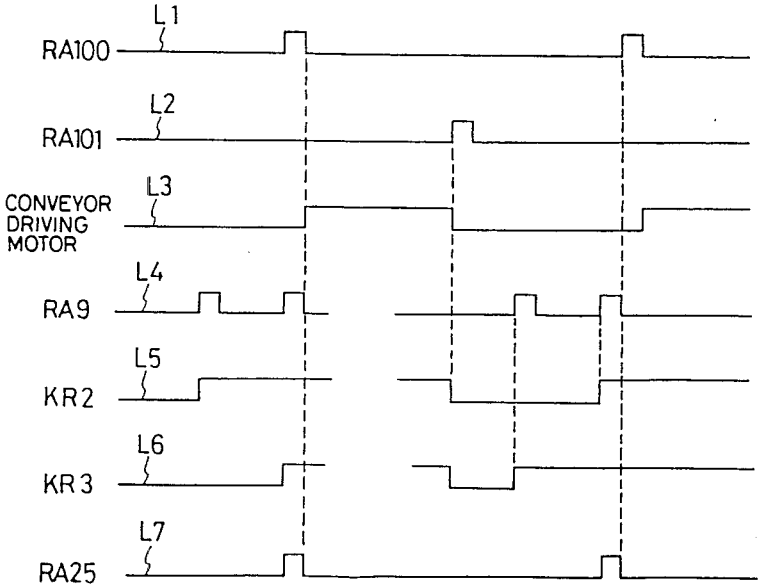
FIG. 18 a timing chart showing an embodiment of a method of the present invention.

Thus, packages PA and PB from the zones ZA and ZB, respectively, are transported in pair under control of the controlling circuits 112 and 120. FIG. 18 is a timing chart showing the operations described above. The line L1 indicates on and off states of the transportation instructing relay RA100 on the body side, and the line L2 indicates on and off states of the relay RA101 for a transportation completion signal which may be obtained from another signal representing that packages PA and PB have been both discharged from the conveyor 101 of the winder or a different signal representing that operation of the package exchanging device 111 is completed or some other signals. The line L3 indicates rotation and stopping of the driving motor for the conveyor 101, and the line L4 indicates operation of the contacts RA9-1 and RA9-2 which are turned on or off in response to a signal produced from a driving cam of the doffing device provided in the doffing truck 104. Further, the line L5 indicates operation of the keep relay KR2 for storage of doffing in the zone ZA while the line L6 indicates operation of the keep relay KR3 for storage of doffing in the zone ZB, and the line L7 indicates operation of the transportation instructing relay KR25 on the truck side which is turned on only when a pair of packages PA and PB are doffed.

As apparent from the foregoing description, it is made possible to deliver those of fully wound packages discharged from a winder which are doffed from different winding zones in a predetermined order from the winder to a next step. Accordingly, processing of packages at the next step is facilitated without the necessity of an operation of identifying a type of a package.

According to the present invention, an automatic winder and a two-for-one twisting machine for a yarn supply package of a two stage type are connected to each other such that a package doffed on the winder may be supplied directly to the two-for-one twisting machine. Accordingly, an operation for exchanging yarn supply packages on the two-for-one twisting machine can be carried out with a high efficiency.

What is claimed is:

1. In combination with a winder and a two-for-one twisting machine, the improvement comprising a yarn supply package exchanging device located adjacent the winder and the two-for-one twisting machine and operatively connecting the winder and the two-for-one twisting machine to each other, said package exchanging device having transferring means for transferring packages from the winder to the two-for-one twisting machine.

2. An interconnecting system operable with a winder and a two-for-one twisting machine, said system comprising a yarn supply package exchanging device for transferring a set of two packages arranged in two stages is located between the automatic winder and the two-for-one twisting machine and connects said winder and said two-for-one twisting machine to each other.

3. The system as claimed in claim 2, said system further comprising a yarn support for supporting two packages and a tray for supporting the yarn support, wherein the winder has a first transporting conveyor for transporting the two packages and the two-for-one twisting machine has a second transporting conveyor for transporting the tray, said yarn supply package exchanging device comprises transferring means for transferring two packages transported on the first transporting conveyor to the yarn support fitted on the tray which is conveyed on the second transporting conveyor.

4. The system as claimed in claim 3, wherein the tray comprises a disk-shaped member having a peg extending therefrom and said yarn support comprises a substantially cylindrical package supporting member configured to be fitted on the pig of the tray and configured to support two packages comprising a lower stage package and an upper stage package, and said yarn support further comprising a yarn guide plate in the form of a disk fitted between the packages, a flanged portion for supporting a bobbin thereon being formed at a lower end of said supporting member wherein the two packages and the yarn support are arranged as a unitary body and, said system further comprising grasping means for grasping the unitary body and for supplying the unitary body to a spindle of the two-for-one twisting machine.

5. The system as claimed in claim 4, wherein said yarn supply package exchanging device comprises a package receiving member mounted for sliding movement in up and down directions and for pivotal motion, and a guide device for positioning and guiding a package to be fitted on the substantially cylindrical package supporting member on the tray.

6. The system as claimed in claim 5, wherein said package receiving member comprising a box-shaped member having a bottom wall for receiving and supporting an end face of a layer of yarn of a package, said box-shaped member having a side wall on which a groove is formed, said package receiving member further comprising an arm which is securely mounted on the side wall of said box-shaped member, and driving member for moving the arm up and down and for rotating the arm forwardly and reversely in a horizontal direction.

7. The system as claimed in claim 6, wherein said package receiving member further includes a pair of empty bobbin gripping members arranged adjacent the bottom wall of the box-shaped member and supported for rotation on a lower face of the bottom wall on opposite sides of the groove, respectively, a pair of rollers supported at ends of the empty bobbin gripping members, and a pressing member for effecting gripping and releasing of an empty bobbin so that the empty bobbin may be gripped by and dropped from the package receiving member.

8. The system as claimed in claim 5, wherein said guide device comprises a guide rod having a flanged portion, a cylindrical portion and a conical portion formed in an integral relationship, said guide rod being securely mounted on a piston rod, said guide device further comprises a plate surrounding the guide rod and configured to hold the guide plate at a lower end portion of tho plate, wherein said package supporting member has an upper end provided with an opening and said guide rod is configured to partially fit into the opening at the upper end of the package supporting member.

9. The system as claimed in claim 2, wherein said winder comprises first and second winding zones, said first winding zone for producing packages having a smaller amount of yarn thereon said second winding zone for producing packages having a greater amount of yarn thereon, and arranging means for arranging a package doffed in the first winding zone and another package doffed in the second winding zone in a group to be transported in a predetermined order.

10. The system as claimed in claim 9, wherein said winder includes a plurality of winding units arranged in a juxtaposed relationship, a transporting conveyor, a doffing truck operable to travel along the plurality of winding units, a metering mechanism for a package provided for each winding unit, a controlling device for controlling timing of the operation of the doffing truck and timing of the operation of the transporting conveyor, a boundary indicia located at a boundary between the two zones of the winder on a travelling path of the doffing truck, and a boundary indicia detecting means located on the doffing truck.

11. A method for doffing and transporting packages in an automatic winder having a plurality of winding units divided into a plurality of winding zones in which different types of packaged are produced, said method comprising the steps of doffing a preset number of packages from each of said winding zones onto a package transporting conveyor which extends along said winding zones, arranging the different types of doffed packages in a predetermined order, and driving said conveyor to transport the packages of the different types in the predetermined order.

12. An apparatus for transferring packages wound by a winder between the winder and the spindles of a two-for-one twisting machine, said apparatus comprising:

receiving means for receiving a plurality of packages wound by the winder;

arranging means for arranging the plurality of packages received by said receiving means into a multistage supply package, said multistage supply package comprising at least two packages arranged for simultaneous supply to a spindle of the two-for-one twisting machine; and supplying means for supplying the multistage supply package to the two-for-one twisting machine.

13. An apparatus as claimed in claim 12, wherein:

the winder has a plurality of winding units, each winding unit being operable for providing a wound package;

the two-for-one twisting machine has a plurality of spindles, each spindle being operable with a multistage supply package;

said receiving means comprises a first conveyor means for conveying wound packages toward said arranging means and delivering packages to said arranging means; and said supplying means comprises a second conveyor means for conveying multistage supply packages from said arranging means toward the spindles.

14. An apparatus as claimed in claim 13, wherein said second conveyor means comprises:

a multistage supply package transport path arranged along the spindles of the two-for-one twisting machine;

package moving means for moving the multistage supply package along said multistage supply package transport path from said arranging means; and multistage supply package transfer means for transferring the multistage supply package from the multistage supply package transport path to a spindle of the two-for-one twisting machine.

15. An apparatus as claimed in claim 13, further comprising:

package supporting means for supporting a plurality of wound packages, said package supporting means configured to be conveyed by said second conveyor means;

wherein said arranging means comprises package loading means for loading a plurality of packages on said package supporting means.

16. An apparatus as claimed in claim 15, wherein:

said package supporting means comprises a substantially cylindrical member having a first end and a second end, and a guide plate extending from said substantially cylindrical member between said first and second ends; and said loading means comprises means for loading one package of said plurality of packages on said substantially cylindrical member between said second end and said guide plate and another package of said plurality of packages on said substantially cylindrical member between said guide plate and said first end.

17. An apparatus as claimed in claim 16, wherein:

said plurality of winding units comprises a first plurality of units for winding a first type of package and a second plurality of units for winding a second type of package, said first type of package having at least one characteristic which differs from said second type of package;

said apparatus further comprises ordering means for providing said first and second types of packages to said loading means in a predetermined order, whereby the type of package loaded between said second end and said guide plate and the type of package loaded between said guide plate and said first end is predetermined.

18. An apparatus as claimed in claim 17, wherein said at least one characteristic comprises at least one of the type of yarn wound on the package and the amount of yarn wound on the package.

19. An apparatus as claimed in claim 15, wherein said package loading means comprises:

a package receiving member shaped to hold a package delivered by said first conveyor means; and movable support means for movably supporting said package receiving member for movement between said first conveyor means and said second conveyor means.

20. An apparatus as claimed in claim 19, wherein:

each wound package includes a bobbin;

said package supporting means is further operable for supporting bobbins; and said package loading means further comprises first holding means for holding said package supporting means, second holding means for holding a bobbin supported by said package supporting means, movement means for moving said first and second holding means away from each other for removing a bobbin from said package supporting means and releasing means for releasing a bobbin held by said second holding means.

21. An apparatus as claimed in claim 13, wherein said first conveyor means comprises:

a package transfer path arranged along the winding units and extending toward said arranging means;

package moving means for moving packages along said package transfer path toward said arranging means in the order in which the packages are supplied to said package transport path; and doffing means for doffing wound packages from the winding units and for supplying the doffed packages to said package transfer path.

22. An apparatus as claimed in claim 21, wherein:

said plurality of winding units comprises a first plurality of units for winding a first type of package and a second plurality of units for winding a second type of package, said first type of package having at least one characteristic which differs from said second type of package;

said doffing means comprises ordering means for supplying packages of said first and second types to said package transfer path in a predetermined order;

whereby packages of said first and second types are delivered to said arranging means in said predetermined order.

23. A method of operating a package arranging device for transferring packages between a winder and the spindles of a two-for-one twisting machine, said method comprising the steps of:

positioning the package arranging device adjacent the winder and the two-for-one twisting machine;

conveying a plurality of packages from the winder to the package arranging device;

arranging the plurality of packages with the package arranging device in a single supply package which comprises at least two packages arranged for simultaneous supply to one of the spindles of the two-for-one twisting machine; and conveying the supply package toward the spindles of the two-for-one twisting machine.

24. A method as claimed in claim 23, wherein:

the winder is operable for winding a package of a first type and a package of a second type, wherein said package of the first type differs from the package of the second type in at least one of the characteristics of yarn type and yarn amount; and said step of conveying a plurality of packages comprises the steps of arranging packages of the first and second types in a predetermined order, and supplying the packages in said predetermined order to the package arranging device.

25. A method as claimed in claim 24, wherein said step of arranging the plurality of packages comprises the step of arranging a package of the first type and a package of the second type in the supply package in an order dependent on said predetermined order.

* * * * *